US005131810A

United States Patent [19]

Wang

[11] Patent Number: 5,131,810

[45] Date of Patent: Jul. 21, 1992

[54] FAN WITH ROTATABLE GRILL

[75] Inventor: Jui-Shang Wang, Taipei, Taiwan

[73] Assignee: Duracraft Corporation, Sudbury, Mass.

[21] Appl. No.: 617,718

[22] Filed: Nov. 23, 1990

[51] Int. Cl.[5] ..... F04D 29/56

[52] U.S. Cl. ..... 415/208.1; 416/247 R

[58] Field of Search ..... 415/208.1, 211.2, 191, 415/119; 416/247 R

[56] References Cited

U.S. PATENT DOCUMENTS

| | | | |
|---|---|---|---|
| 910,760 | 1/1909 | Wood | 415/208.2 |
| 4,120,615 | 10/1978 | Keem et al. | 415/211.2 |
| 4,350,472 | 9/1982 | Morimoto | 415/211.2 |

*Primary Examiner*—John T. Kwon

*Attorney, Agent, or Firm*—John E. Toupal; Harold G. Jarcho

[57] ABSTRACT

A fan apparatus including a housing defining an air inlet opening, an air discharge opening; and a bearing surface; a fan blade rotatably mounted in the housing and adapted to provide air flow in a given direction between the inlet and discharge openings; and a deflector rotatably mounted in the discharge opening on the bearing surface and shaped and arranged to interrupt and redirect air discharged thereby, the deflector adapted to be rotatably propelled in the discharge opening by air discharged thereby. Also included is a resilient member engaged between the deflector and the housing and exerting therebetween a force establishing a level of friction between the deflector and the bearing surface. The resilient member establishes smooth and uniform rotation of the deflector.

16 Claims, 2 Drawing Sheets

FAN WITH ROTATABLE GRILL

BACKGROUND OF THE INVENTION

This invention relates generally to an air moving fan device and, more particularly, an air moving fan device having an improved rotatable air deflector grill.

Generally, the airflow produced by a fan blade has two components. One is a linear component moving axially and caused by the pitch of a typical blade. The other is a circular component caused by the turbulence of the blade and its rotation. Together they create helically directed airflow that is commonly used to drive a rotatable grill and thereby change a fan's air discharge pattern. Prior fans of this type have exhibited various problems including complicated construction, inadequate control of grill rotation, fluctuating rotational grill speed, undesirable grill vibration, etc.

The object of this invention, therefore, is to provide a portable fan having an improved air driven protective grill for automatically and continuously changing the fan's air discharge pattern.

SUMMARY OF THE INVENTION

The invention is a fan apparatus including a housing defining an air inlet opening, an air discharge opening; and a bearing surface; a fan blade rotatably mounted in the housing and adapted to provide air flow in a given direction between the inlet and discharge openings; and a deflector rotatably mounted in the discharge opening on the bearing surface and shaped and arranged to interrupt and redirect air discharged thereby, the deflector adapted to be rotatably propelled in the discharge opening by air discharged thereby. Also included is a resilient means engaged between the deflector and the housing and exerting therebetween a force establishing a level of friction between the deflector and the bearing surface. The resilient means establishes smooth and uniform rotation of the deflector.

According to one feature of the invention, the housing further comprises a spider portion disposed in the discharge opening and defining the bearing surface and the deflector means is a circular grill supported by the bearing surface.

According to other features of the invention, the bearing surface includes a cylindrical surface portion extending in the given direction and a planar surface portion extending transverse thereto, and the resilient means is adapted to exert the force is substantially the given direction between the planar portion and the housing. This structural arrangement optimally generates the desired frictional force between the deflector and the bearing surface.

According to yet another feature of the invention, the housing further comprises a manually adjustable operator for selectively varying the force to thereby vary the level of friction established between the deflector and the bearing surface. The operator facilitates rotational speed control of the deflector thereby permitting the selection of a desired air discharge distribution pattern.

According to still other features of the invention, the resilient means includes an annular resilient member having an axis substantially parallel to the given direction, the housing includes a shaft extending through the annular resilient member and terminating with the operator, and the resilient member is engaged between the bearing surface and the operator. This arrangement facilitates grill rotational speed control by the operator.

According to further features of the invention, the shaft is threadedly engaged with the spider portion, the deflector comprises an annular cup-shaped portion having a cylindrical inner wall and a cylindrical outer wall joined by a bottom wall, the inner, outer and bottom walls define an annular cavity, and the inner wall engages the cylindrical surface and the bottom wall is engaged between the planar surface portion and the resilient member. These features provide the desired rotational speed control in a mechanically efficient structural arrangement.

According to still further features of the invention, the resilient means further comprises an annular cup-shaped bushing retained in the annular cavity and defining an annular recess, and the resilient member is a spring retained in the cavity. The annular cup-shaped bearing isolates the spring member from the rotating grill.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENT

Figure 1:
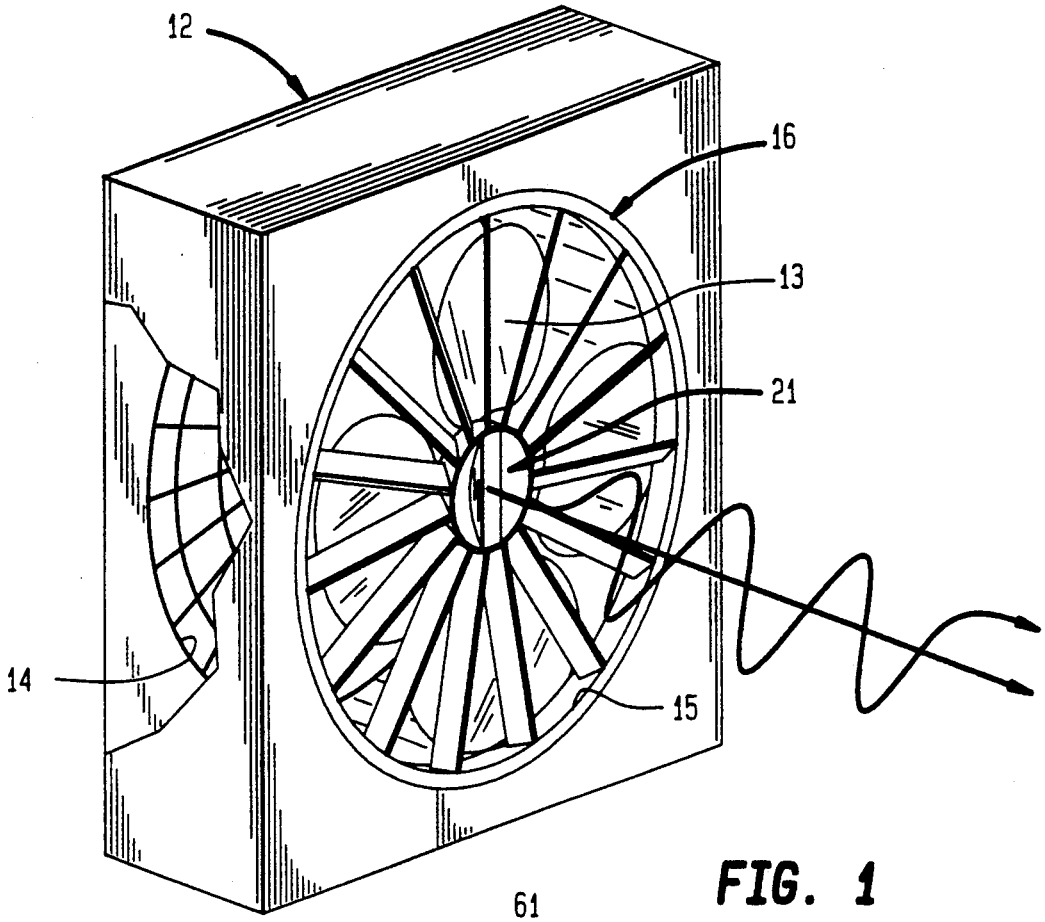
FIG. 1 is a front perspective view of a fan device according to the invention.
Figure 2:
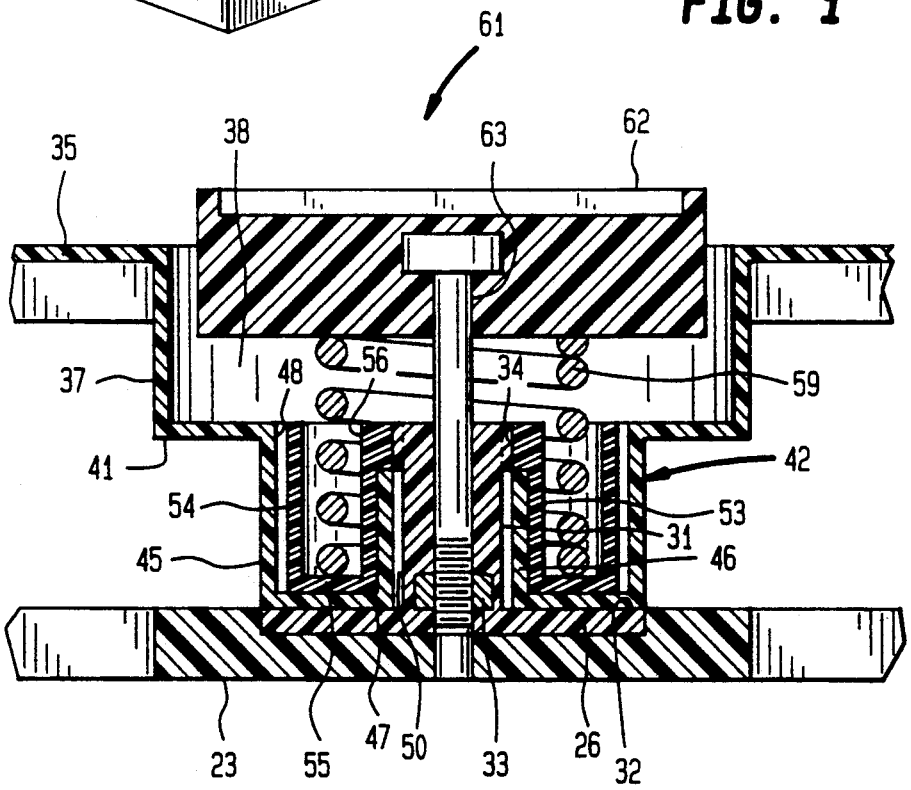
FIG. 2 is a partial cross-sectional view illustrating a control assembly shown in FIG. 1.

A fan device 11 includes a housing 12 that retains a fan blade 13. Defined by the housing 12 is a rear inlet opening 14 and a front discharge opening 15. A deflector grill 16 is rotatably retained by the housing 12 in the discharge opening 15. Air moved by the fan blade 13 between the inlet opening 14 and the discharge opening 15 is intercepted and re-directed in a given direction by the deflector grill 16. A control assembly 21 including portions of the housing 12 extends through a central portion of the deflector grill 16.

Figure 3:
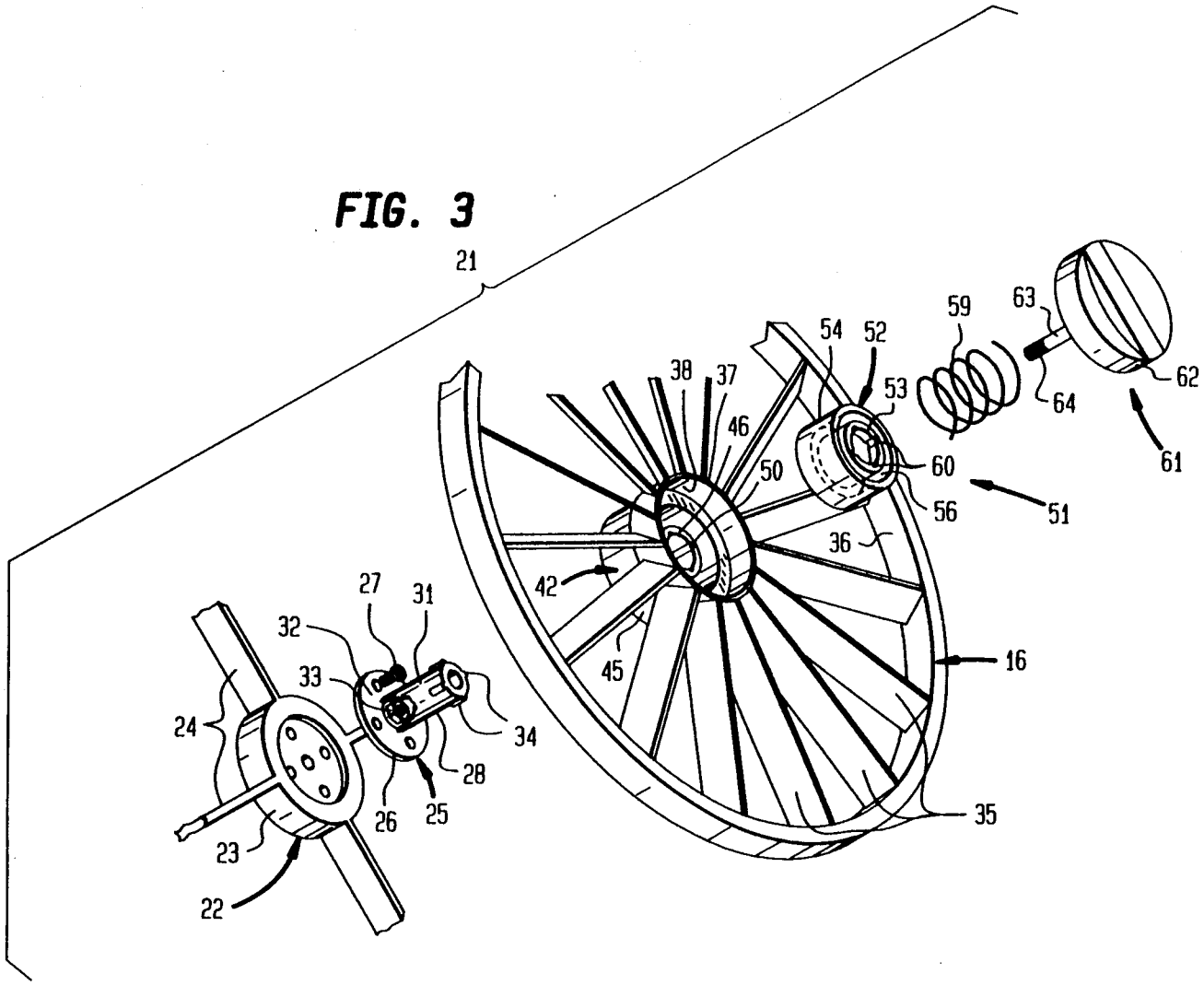
FIG. 3 is an exploded view of the control assembly shown in FIG. 2.

The housing 12 includes a spider portion 22 having a central body 23 supported by radial legs 24. Also included in the spider portion 22 is a spindle 25 having a circular base plate 26 secured to the central body 23 by screws 27 and an axially directed hollow shaft 28. An outer surface of the axial shaft 28 forms a cylindrical bearing surface 31 extending parallel to the direction of airflow between the inlet opening 14 and the discharge opening 15 while an outer surface of the base plate 26 defines a planar bearing surface 32 extending transversely thereto. Retained centrally by the spindle 25 within the hollow shaft 28 is an internally threaded nut 33 as shown most clearly in FIGS. 3 and 4. A plurality of keys 34 are formed on the outer end of the shaft 28.

The deflector grill 16 includes a plurality of radially directed vanes 35 extending between a circular outer rim 36 and a hollow cylindrical inner rim 37 that defines a chamber 38. Connected to an inner end of the cylindrical rim 37 by a shoulder portion 41 is an annular cup-shaped hub 42. A cylindrical outer wall 45 of the hub 42 is connected to a cylindrical inner wall 46 thereof by a bottom wall 47. Together the outer wall 45, the inner wall 46 and the bottom wall 47 define an annular cavity 48. The bottom wall 47 of the hub 42 engages the planar bearing surface 32 of the spindle 25 while the inner wall 46 of the hub 42 engages the cylindrical bearing surface 31 of the axial shaft 28. A plurality of keyways 50 in the inner wall 46 permit passage of the keys 34 on the shaft 28.

Retained within the annular cavity 48 is a resilient assembly 51 that exerts a force between the housing 12 and the deflector 16 as described hereinafter. The assembly 51 includes an annular cup-shaped bushing 52 having an inner wall 53, an outer wall 54 and a bottom wall 55 that form an annular recess 56. Also included in the assembly 51 is a resilient, annular, spring member 59 that is retained in the annular recess 56. A plurality of keyways 60 in the inner wall 53 receive the keys 34 and thereby fix the bushing 52 to the shaft 28.

Additionally defined by the housing 12 is an operator assembly 61 including a knob 62 and a shaft 63 fixed to and extending therefrom. An end 64 of the shaft 63 opposite to the knob 62 is externally threaded. Receiving the knob 62 is the chamber 38 formed by the cylindrical inner rim 37 of the deflector 16. The shaft 63 extends through the annular spring member 59, the annular bushing 52, the cup-shaped hub 42 and the hollow shaft 28 to threadedly engage the nut 33.

OPERATION

Air flow produced by rotation of the fan blade 13 is intercepted and redirected by the vanes 35 of the deflector grill 16. The tangentially directed forces generated by contact between the air flow and the vanes 35 induces rotation of the deflector grill 16 to continuously change direction of air flow into a region occupied by the device 11. During this rotation of the deflector grill 16, axial movement thereof is restricted by engagement of the bottom wall 47 of the hub 42 between the planar bearing surface 32 of the spindle 25 and the bottom wall 55 of the bushing 52. Transverse motion of the deflector grill 16 is restricted by engagement between the inner wall 46 of the hub 42 and the cylindrical bearing surface portion 31 of the axial shaft 28. To reduce friction, the spindle 25 and the bushing 52 preferably are molded of a suitable material having a high degree of lubricity.

The spring member 59 is maintained under compression between the knob 62 and the bushing 52 causing the bottom wall 55 thereof to exert forces that maintain a substantial level of friction between the bottom wall 47 of the hub 42 and the planar bearing surface 32 of the spindle 25 regardless of variations in surface contact therebetween caused by molding inaccuracies. Consequently, the rotational speed of the deflector grill 16 is maintained substantially constant ensuring a more even distribution of air flow by the device 11.

The rotational speed of the deflector grill 16 can be desirably controlled by manual adjustment of the knob 62. Clockwise rotation of the knob 62 moves the shaft portion 64 inwardly into the nut 33 in the spindle 25 to thereby increase the force exerted by the spring member 59 between the hub 42 and the bearing surface 32 of the spindle 25. In that manner, the rotational speed of the grill 16 can be reduced or stopped if desired. Conversely, counterclockwise rotation of the knob 62 moves the shaft portion 64 outwardly in the nut 33 to decrease the force exerted by the spring member 59 and thereby increasing rotational speed of the deflector grill 16.

Obviously, many modifications and variations of the present invention are possible in light of the above teachings. It is to be understood, therefore, that the invention can be practiced otherwise than as specifically described.

What is claimed is:

1. A fan apparatus comprising:

housing means defining an air inlet opening, an air discharge opening; and a bearing surface means comprising a cylindrical surface portion extending in said given direction and a planar surface portion extending transverse thereto;

a fan blade rotatably mounted in said housing means and adapted to provide air flow in a given direction between said inlet and discharge openings;

deflector means rotatably mounted in said discharge opening on said bearing surface and shaped and arranged to interrupt and redirect air discharged thereby, said deflector means adapted to be rotatably propelled in said discharge opening by air discharged thereby; and said deflector means comprising an annular cup-shaped portion having a cylindrical inner wall and a cylindrical outer wall joined by a bottom wall; said inner, outer and bottom walls defining an annular cavity; and wherein said inner wall engages said cylindrical surface and said bottom wall is engaged between said planar surface portion and said resilient means; and resilient means engaged between said deflector means and said housing means and exerting therebetween a force establishing a level of friction between said deflector means and said bearing surface means.

2. A fan apparatus according to claim 1 wherein said housing means further comprises a spider portion disposed in said discharge opening and defining said bearing surface means.

3. A fan apparatus according to claim 2 wherein said deflector means is a circular grill supported by said bearing surface means.

4. A fan apparatus according to claim 3 wherein said resilient means is adapted to exert said force in substantially said given direction between said planar surface portion and said deflector means.

5. A fan apparatus according to claim 4 wherein said resilient means comprises an annular resilient member having an axis substantially parallel to said given direction, said housing means comprises a shaft extending through said annular resilient member and terminating with a terminal portion, and said resilient means is engaged between said bearing surface means and said terminal portion.

6. A fan apparatus according to claim 5 wherein said shaft is threadedly engaged with said spider portion.

7. A fan apparatus according to claim 6 wherein said resilient means further comprises an annular cup-shaped bushing retained in said annular cavity and defining an annular recess retaining said annular resilient member.

8. A fan apparatus according to claim 7 wherein said resilient means comprises a spring exerting said force between said deflector means and said housing means.

9. A fan apparatus according to claim 1 wherein said housing means comprises manually adjustable operator means for selectively varying said force to thereby vary said level of friction established between said deflector means and said bearing surface means.

10. A fan apparatus according to claim 9 wherein said housing means further comprises a spider portion disposed in said discharge opening and defining said bearing surface means.

11. A fan apparatus according to claim 10 wherein said deflector means is a circular grill straddled by said bearing surface means and said operator means.

12. A fan apparatus according to claim 11 wherein said resilient means is adapted to exert said force in substantially said given direction between said planar surface portion and said deflector means.

13. A fan apparatus according to claim 12 wherein said resilient means comprises an annular resilient member having an axis substantially parallel to said given direction said housing means comprises a shaft extending through said annular resilient member and terminating with said operator means, and said resilient means is engaged between said bearing surface means and said operator means.

14. A fan apparatus according to claim 13 wherein said shaft is threadedly engaged with said spider portion, and said operator means comprises a manually operable knob.

15. A fan apparatus according to claim 14 wherein said resilient means further comprises an annular cup-shaped bushing retained in said annular cavity and defining an annular recess retaining said annular resilient member.

16. A fan apparatus according to claim 15 wherein said resilient means comprises a spring exerting said force between said deflector means and said housing means.

* * * * *